US006905387B2

(12) United States Patent
Benson

(10) Patent No.: US 6,905,387 B2
(45) Date of Patent: Jun. 14, 2005

(54) FLYABLE BALL

(76) Inventor: Donald M. Benson, 3433 E. 100th St., Grant, MI (US) 49327

( * ) Notice: Subject to any disclaimer, the term of this patent is extended or adjusted under 35 U.S.C. 154(b) by 0 days.

(21) Appl. No.: 10/672,471

(22) Filed: Sep. 26, 2003

(65) Prior Publication Data

US 2005/0070197 A1 Mar. 31, 2005

(51) Int. Cl.[7] ..... A63H 27/00
(52) U.S. Cl. ..... 446/34; 446/46
(58) Field of Search ..... 446/34, 46, 47, 446/48

(56) References Cited

U.S. PATENT DOCUMENTS 290,788 A * 12/1883 Moyer ..... 273/362
2,835,073 A * 5/1958 Dame ..... 446/48
3,716,229 A * 2/1973 Van Der Cleyen et al. ... 482/77
3,758,985 A * 9/1973 Heisler ..... 446/46
4,248,010 A * 2/1981 Fox ..... 446/47
4,262,911 A * 4/1981 Opresik et al. ..... 473/613
4,580,990 A * 4/1986 Avery ..... 446/46
5,045,011 A * 9/1991 Lovik ..... 446/46
5,287,561 A * 2/1994 Spector ..... 2/209.11
5,360,363 A * 11/1994 Levin ..... 446/46
5,984,753 A * 11/1999 Perez ..... 446/46

* cited by examiner

*Primary Examiner*—Derris H. Banks
*Assistant Examiner*—Ali Abdelwahed
(74) *Attorney, Agent, or Firm*—Charles R. Rutherford; Dykema Gossett PLLC

(57) ABSTRACT

The flyable ball has a unitary spherically shaped body made from a resilient material, with the body having a center axis and a transverse center axis. The body further includes a radially outward extending ring or rim projecting from the body and located below the transverse center axis for supplying centrifugal stabilization to the body when the ball is thrown into the air with a spin.

1 Claim, 2 Drawing Sheets

FLYABLE BALL

BACKGROUND OF THE PRESENT INVENTION

1. Field of the Invention

The present invention relates to an object such as a toy or ball which, when rotated or spinned through the air, utilizes centrifugal force and gyroscopic and aerodynamic principles to fly though the air. The object is held and thrown into the air in much the same manner a FRISBEE disk.

2. Brief Description of the Prior Art

The flight of the FRISBEE disk has been known for many years. It consists of a unitary, generally circular plastic body in the shape of a plate or pie tin or of similar configuration which forms a wing and when spun in the air, stays aloft due to aerodynamic lift and gyroscopic stability. Forward flight splits rushing air at the leading edge of the airborne disk. Half of the air goes over the top of the disk and the other half of the air goes underneath the disk. Because the edge of the disk is tipped up, the disk deflects the lower airstream downward. As the disk pushes down on the air, the air pushes upward on the disk resulting in a force known as the aerodynamic lift. The upper airstream is also deflected downward like all viscus fluids, since flowing air tends to follow curved surfaces even when those surfaces bend away from the airstream. The inward bend of the upper airstream is accompanied by a substantial drop in air pressure just above the disk thereby sucking the disk upward.

The prior art further includes the following U.S. patents: U.S. Pat. No. 3,758,985 issued on Sep. 18, 1973 to Heisler entitled "Discus Toy"; U.S. Pat. No. 4,262,911 issued on Apr. 21, 1981 to Opresik et al entitled "Martian Flyer or Earth U.F.O."; U.S. Pat. No. 4,335,536 issued Jun. 22, 1982 to Magid et al entitled "Inflatable Throwing Toy"; U.S. Pat. No. 5,045,011 issued Sep. 3, 1991 to Lovik entitled "Flying Balloon Toy"; U.S. Pat. No. 5,123,869 issued Jun. 23, 1992 to Schipmann entitled "Aerodynamic Toy"; U.S. Pat. No. 5,360,363 issued Nov. 1, 1994 to Levin entitled "Flying Disk with Rotatable Member"; U.S. Pat. No. 5,882,239 issued Mar. 16, 1999 issued to Trichak entitled "Illuminatable Aerodynamic Disc or Saucer"; and U.S. Pat. No. 5,984,753 issued Nov. 16, 1999 to Perez entitled "Aerodynamic Toy".

SUMMARY OF THE PRESENT INVENTION

A feature of the present invention relates to a flyable ball comprising a unitary spherically shaped body made from a resilient material, with the body having a center axis, a transverse center axis and a radially outwardly extending annular ring or rim projecting from the body and located below the transverse center axis for supplying centrifugal stabilization when the ball is thrown through the air with a spin.

Another feature of the present invention is to provide a flyable ball of the aforementioned type wherein the annular rim includes a pair of surfaces which are configured and shaped to form an air foil which causes lift and guides the ball in flight after the ball is spun through the air and thrown by a person gripping the annular rim.

Still another feature of the present invention is to provide a flyable ball of the aforementioned type wherein the body has a hollow interior and is inflatable with air directed through a valve provided in the body.

A further feature of the present invention is to provide a flyable ball of the aforementioned type wherein the resilient material is vinyl plastic.

A still further feature of the present invention is to provide a flyable ball of the aforementioned type wherein the resilient material of the spherically shaped body is a chemically activated foam which fills the interior thereof.

Another feature of the present invention is to provide a flyable ball of the aforementioned type wherein the ring or rim has an annular groove in one of the surfaces which is furthest away from the transverse axis, with the air moving under the ball creating a vacuum where the air contacts the grooved rim.

Still another feature of the present invention is to provide a flyable ball of the aforementioned type wherein the surface of the annular rim closest to the transverse axis curves in a direction towards the surface provided with the annular groove.

Another feature of the present invention is to provide a toy or ball which is made by a molding process and which is simple in construction, easy to manufacture, economical to produce and efficient in operation.

DESCRIPTION OF THE PREFERRED EMBODIMENT

The present invention discloses two embodiments of the toy, one embodiment having a solid foam interior and the other ball being inflatable, with the interior thereof occupied by air. Each embodiment is made by a molding process, with similar but different molds being used in producing each embodiment. The inflatable ball (FIGS. 5 and 6) is made from vinyl utilizing a conventional rotational molding process. The foam toy is made in a mold in which the chemically activated foam is injected with the foam growing after it is poured into the mold.

Figure 1:
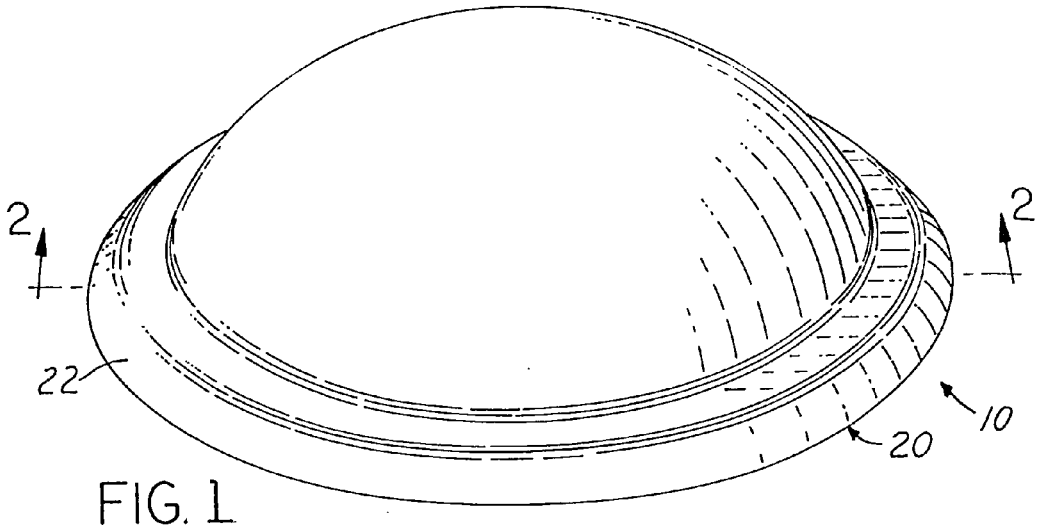
FIG. 1 is a top perspective view of the flyable toy or ball.
Figure 2:
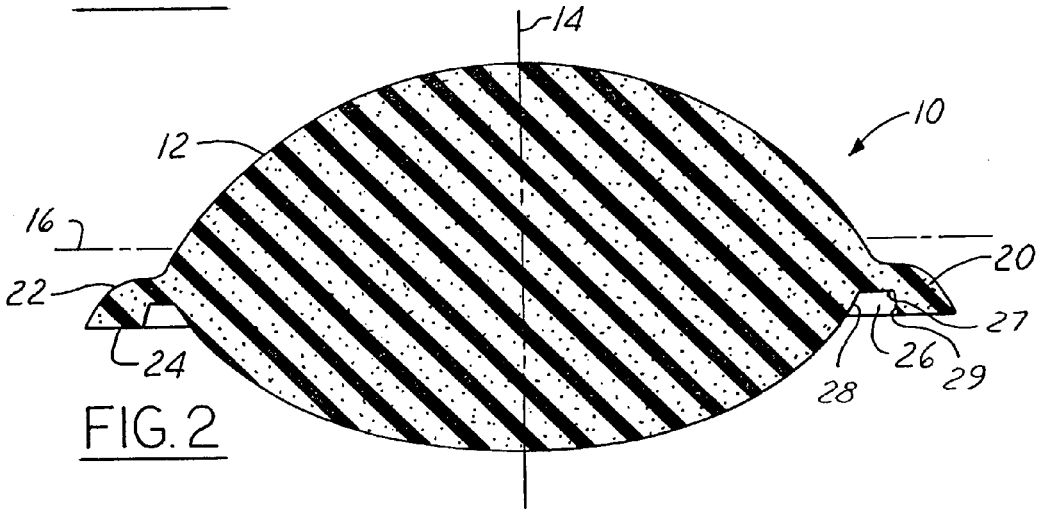
FIG. 2 is a sectional view through the center of the ball taken on the line 2—2 of FIG. 1 and showing the solid foam interior thereof.

Referring now to FIGS. 1 and 2, the toy or ball is designated by the numeral 10. It has a unitary spherically shaped body 12 made from a resilient plastic material such as a chemically activated foam now utilized in producing NERF footballs for children.

The spherically shaped body 12 has a center axis 14 and a transverse axis 16 which intersects and is perpendicular to the center axis 14. The body 12 is provided with a radially outwardly extending annular ring or rim 20 which is located below the transverse axis 16. Because the ring or rim 20 is placed below the transverse axis 16, or the center of the spherical shaped body 12, it creates an air foil which causes lift and a gliding effect when the toy 10 is spinning and passing through the air. The configuration of the body 12 and the softness or resiliency of the material makes the toy easy and safe to catch.

The annular ring or rim 20 includes a pair of surfaces including a first surface 22 which is closest to the transverse axis 16 and a second surface 24 which lies in a plane parallel to the plane containing the axis 16. The first surface 22 is curved away from the body 12 and towards the second surface 24 where it intersects the second surface 24 at the outer edge of the ring or rim 20. The ring 20 is provided with an annular open groove 26 in the second surface 24. The annular open groove 26 has a flat annular surface 27 and a pair of side surfaces 28 and 29. The groove 26 is spaced inwardly from the edge of the ring where the first and second surfaces 22 and 24 intersect.

It should be noted that the upper portion of the spherical shaped body 12 is larger than the lower portion as viewed in FIG. 2. The toy 10 has an outside rim diameter at the edge of the rim of approximately 8⅛ inches. The height of the toy 10 measured along the center axis 14 is approximately 3½ inches. It will be appreciated that the bolt or toy 10 will be made in various sizes using generally the same shape and configuration.

In use, a person standing and throwing this object initially grips the rim 20 and spins the object, either overhand or underhand, backhand or forehand on a horizontal axis which will allow gyroscopic and aerodynamic principles to take effect, thus creating a gliding flight for the ball 10. The ball 10 can also be thrown underhand or overhand on a vertical axis and bounced or rolled across the ground.

Figure 3:
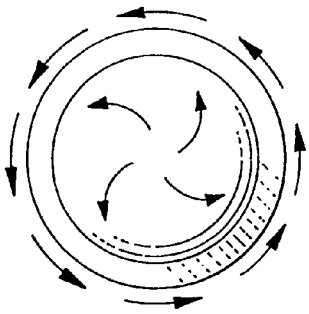
FIG. 3 is a top view of the flyable ball in flight illustrating the air circulating across the top of the ball and around the rim.
Figure 4:
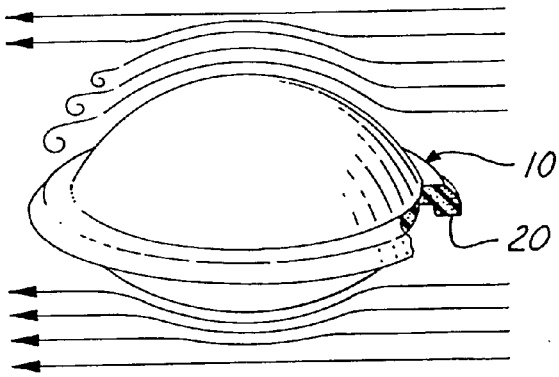
FIG. 4 is a front elevational view of the ball or toy, with a rim part broken away and in section, and illustrating the toy in rotation, with air flowing across the top and bottom of the toy resulting in an upward aerodynamic lift.

When the object or ball 10 is held by the rim and thrown in much the same manner as a person would a FRISBEE disk, the air, as shown in FIG. 4, travels a greater distance over the top of the ball 10 than below the ball 10. The air moving over the ball 10 creates a vacuum where the ball meets the lip or rim 20, thereby aiding in achieving flight. The centrifugal force illustrated in FIG. 3 by the series of arrows creates a gyroscopic stabilization which enables the ball 10 to remain stable in flight when thrown with the spin thereby allowing the aerodynamic principles to take effect.

Figure 5:
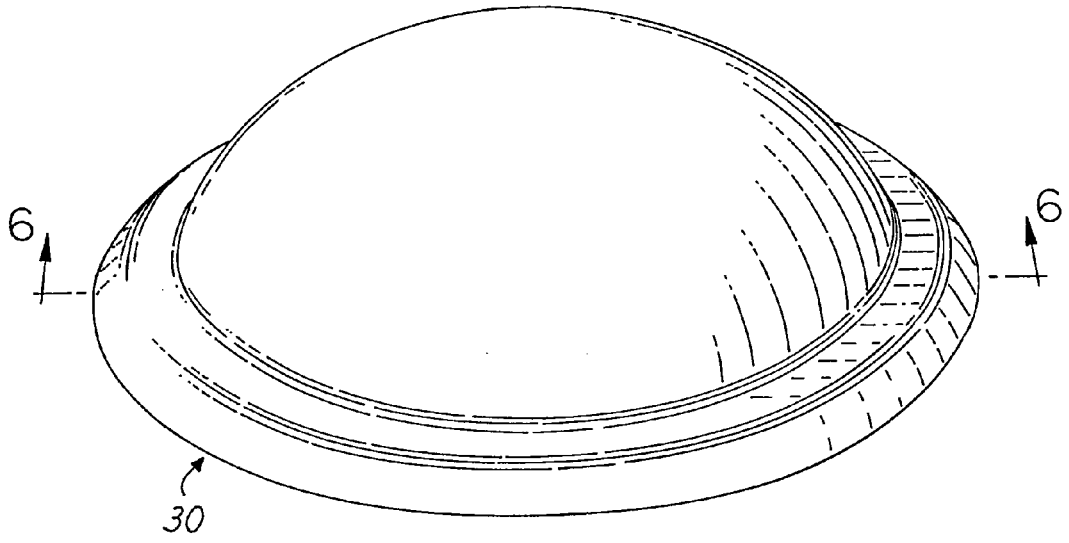
FIG. 5 is a top perspective view of another embodiment of the flyable toy or ball.
Figure 6:
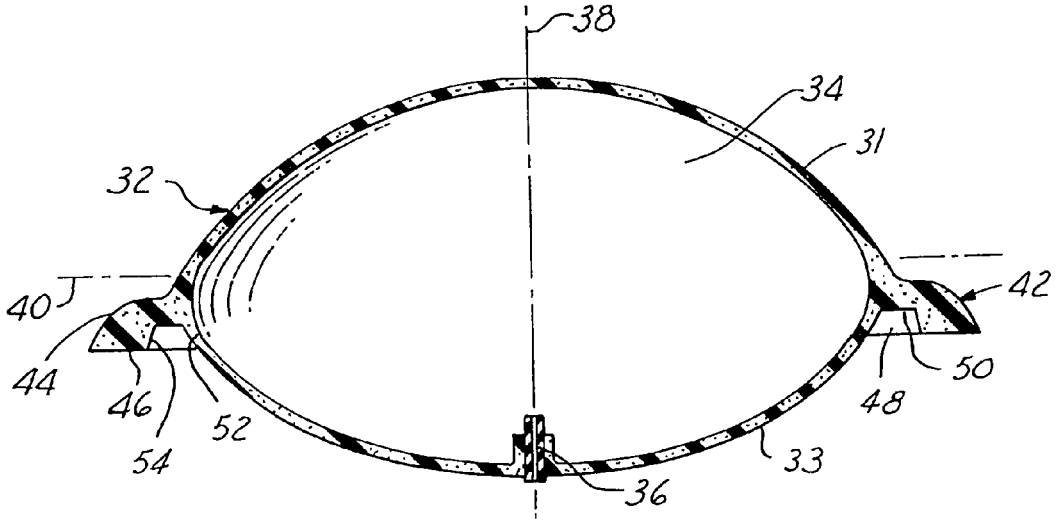
FIG. 6 is a cross sectional view through the ball taken on the line 6—6 of FIG. 5 and illustrating the hollow interior thereof filled with air.

The other embodiment is illustrated in FIGS. 5 and 6 and it discloses an inflatable ball or toy 30 having the same overall appearance as the foam ball illustrated in FIGS. 1 and 2. The spherically shaped ball 30 is made in a rotational molding process utilizing vinyl plastic material which forms the spherically shaped body 32. The interior of the body 32 is hollow and a valve 36 is provided in the lower portion of the body 32 to permit air to be directed into the interior 34 much like an inflatable football or basketball. The body 32 has a center axis 38 and a transverse axis 40. The body 32 has an upper portion 31 and a lower portion 33 and further includes a radially outwardly extending annular rim or ring 42 which is located below the transverse center axis 40 as illustrated in FIG. 6. The rim or ring 42 has a pair of first and second surfaces 44 and 46. The first surface 44 is curved away from the body 32 and towards the second surface 46 where it intersects surface 46 at the outer edge of the rim 42. The second surface 46 is provided with an annular open groove 48 which has a flat annular surface 50 and a pair of side surfaces 52 and 54. The upper portion of the body 32 above the ring or rim 42 is larger in area than the lower portion of the body 32 located below the ring or rim 42. The ring 42 forms an air foil which causes lift and a gliding effect when the ball is spun and is in flight. As with the first embodiment, the configuration of the ball and the softness makes it easy to catch. A person standing and throwing the ball 30 with a spin, either overhand or underhand, backhand or forehand on a horizontal axis allows well known gyroscopic and aerodynamic principles to come into play thus creating a gliding flight for the ball 30. Because the air travels a greater distance across the top of the ball, an aerodynamic lift is created. Air moving under the ball creates a vacuum where the ball meets the grooved rim 42. This also aids in achieving flight.

What I claim is:

1. A flyable ball comprising a spherically shaped body having a center axis and a transverse center axis; a radially outwardly extending annular rim projecting outwardly from and being integral with said body and located below and spaced from said transverse axis; said body and said rim being formed unitarily in a mold from a chemically activated foam which fills the mold to provide a smooth outer surface on said body and said rim, with the interior of said body and said rim being completely and entirely filled with foam; said body having upper and lower portions; the upper portion of said spherically shaped body above said annular rim being larger in area than the lower portion of said body below said annular rim; said annular rim including a pair of first and second intersecting surfaces which are configured and shaped to form an air-foil which causes lift and guides the ball in flight after the ball is spun in the air by a person gripping said annular rim; said second surface which is furthest away from said transverse center axis being straight and parallel to said transverse axis and having an annular open groove provided therein throughout the circumferential extent of said annular rim; said annular open groove having a flat annular surface and a pair of side surfaces; said first surface which is directly opposite to said transverse axis curving outwardly and downwardly from said upper portion and intersecting said second surface; said annular open groove being located and spaced inwardly from the edge of said annular rim where said first and second surfaces intersect; said annular rim providing a hand grip for a person to grip said body and to rotate said body and said rim in the air resulting in the air rushing across the upper and lower portions of said body and said rim causing the air beneath said body to exert an upwardly force on said lower portion thereby creating an aerodynamic lift, with the air moving across the upper portion of said body resulting in a substantial drop in air pressure above said body.

* * * * *